United States Patent [19]

Raines

[11] Patent Number: 5,040,556

[45] Date of Patent: Aug. 20, 1991

[54] WALKER

[76] Inventor: Mary Raines, 521 Hahaione St. 1H, Honolulu, Hi. 96825

[21] Appl. No.: 632,940

[22] Filed: Dec. 24, 1990

[51] Int. Cl.[5] ..... A61A 3/00

[52] U.S. Cl. ..... 135/67; 272/70.3; 297/6

[58] Field of Search ..... 135/67; 272/70.4, 70.3; 297/5, 6

[56] References Cited

U.S. PATENT DOCUMENTS

| | | | |
|---|---|---|---|
| 170,544 | 11/1875 | Garcia | 297/6 |
| 282,980 | 8/1883 | Habegger | 272/70.3 |
| 658,126 | 9/1900 | Settlemyre | 297/6 |
| 2,657,735 | 11/1953 | Hughes | 135/67 |
| 3,350,095 | 10/1967 | Clasen | 297/6 |
| 4,272,071 | 6/1981 | Bolton | 135/67 |
| 4,883,282 | 11/1989 | Wolf | 272/70.3 |

FOREIGN PATENT DOCUMENTS

| | | | |
|---|---|---|---|
| 4488 | of 1901 | United Kingdom | 272/70.3 |

*Primary Examiner*—Henry E. Raduazo
*Attorney, Agent, or Firm*—Michael I. Kroll

[57] ABSTRACT

An improved walker for a handicapped and convalescent person is provided and consists of a pivotally segmented top rail member, a pivotally segmented larger base member with a plurality of ground engaging casters, and a plurality of legs between the top rail member and the base member. The top rail member and the base member are locked after the person has entered the improved walker, so that the person can grip the top rail member for support and move the improved walker along the ground with the hands free. A seat, made of flexible material is attached to the top rail member to drape and pass between the legs of the person so that the person can sit thereon, while the larger base member will help keep stability thereto and prevent the improved walker from falling over.

9 Claims, 2 Drawing Sheets

20
22
24
26
28
30
32
34
36
40
42
44
46
48
50
52
56
58
78
80
82
84
90
92

20
24
26
28
9
42
7
58
36
66
46
60
56
10
32
38
30
34
44
72
6
74
62
76
8
70
68
64
67
88
55
54

WALKER

BACKGROUND OF THE INVENTION

1. Field of the Invention

The instant invention relates generally to mobile support devices and more specifically it relates to an improved walker.

2. Description of the Prior Art

Numerous mobile support devices have been provided in prior art that are adapted to be utilized by elderly people and people with varying degrees of disability. While these units may be suitable for the particular purpose to which they address, they would not be as suitable for the purposes of the present invention as heretofore described.

SUMMARY OF THE INVENTION

A primary object of the present invention is to provide an improved walker that will overcome the shortcomings of the prior art devices.

Another object is to provide an improved walker that will aid handicapped and convalescent persons in having healthier and more independent lives by enabling them to walk unattended without the risk of injury by falling.

An additional object is to provide an improved walker that has a higher center of gravity so that it can be safely and conveniently used by a person who is prone to loose their balance and fall, since the invention has a seat to catch the person, if necessary, if the person falls.

A further object is to provide an improved walker that is simple to use, easy to use and can be used hands free.

A still further object is to provide an improved walker that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figures 1, 2, 3:
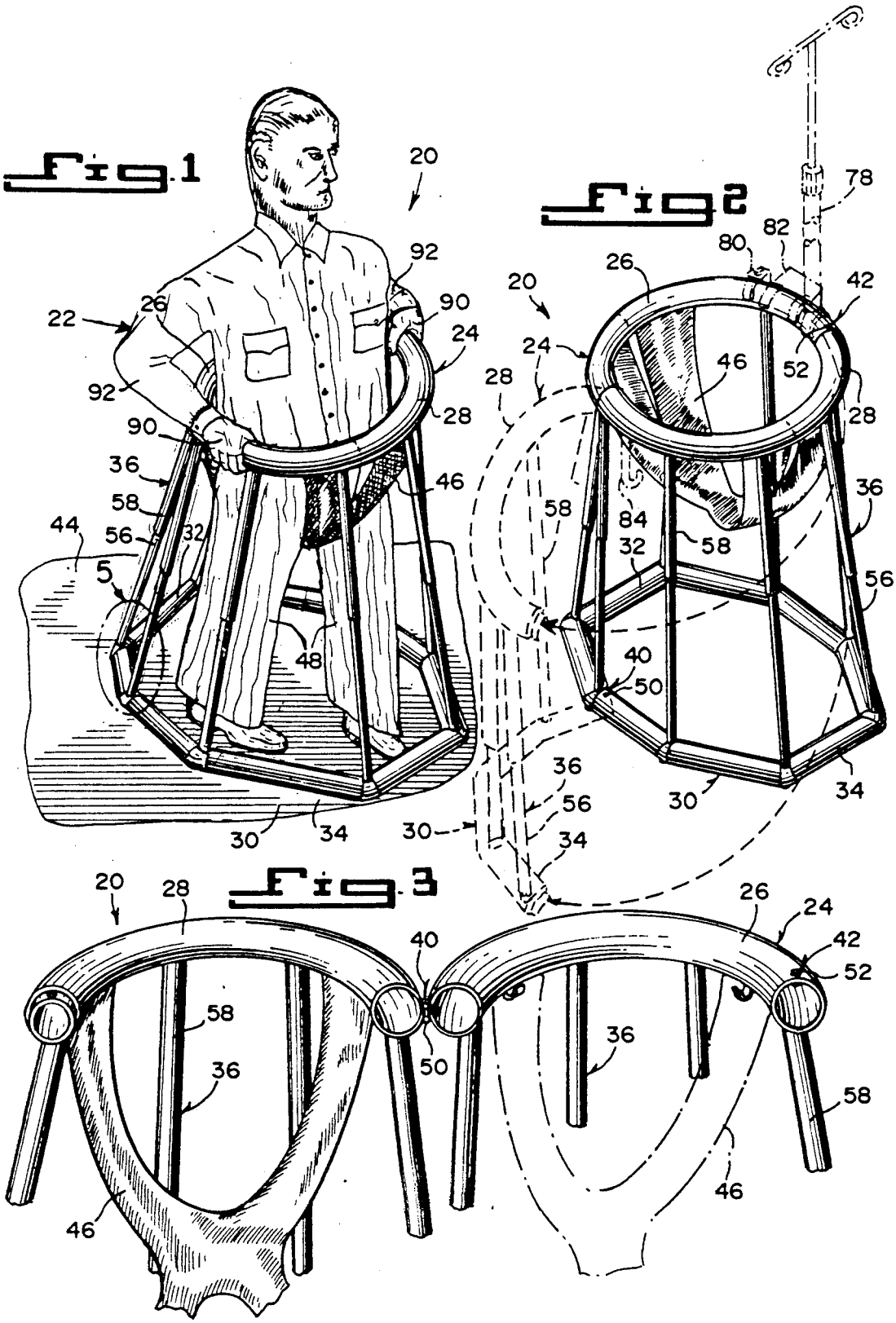
FIG. 1 is a perspective view of the invention being used by a person.
FIG. 2 is a perspective view of the invention showing in phantom how it pivotally opens.
FIG. 3 is a perspective view of an upper portion of the invention in its open position.
Figures 4, 5, 6, 7, 8, 9, 10:
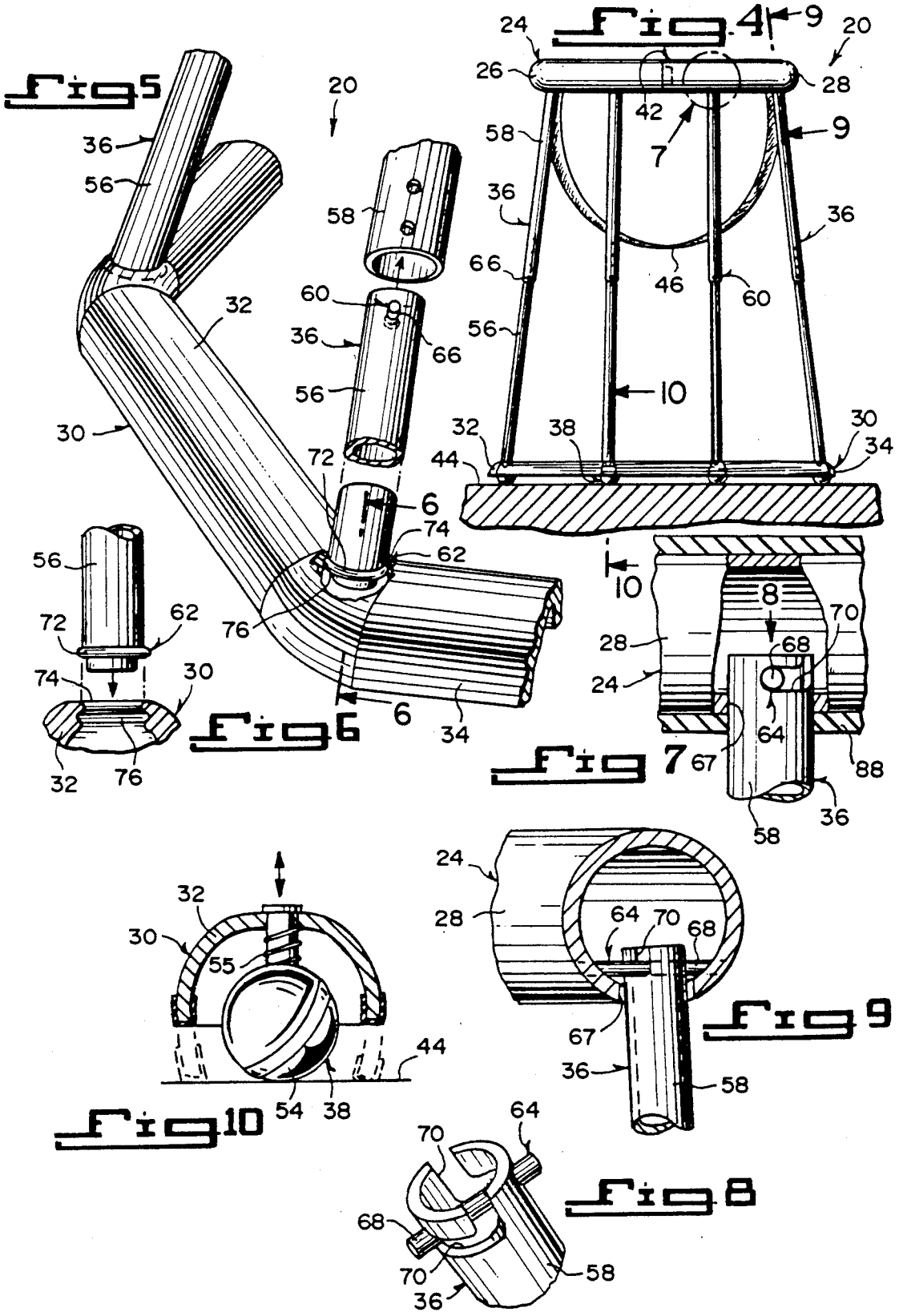
FIG. 4 is a side elevational view taken thereof.
FIG. 5 is an enlarged perspective view as indicated by arrow 5 in FIG. 1.
FIG. 6 is a cross sectional view taken along line 6—6 in FIG. 5, with the bottom end of the lower segment of the leg ready to be attached to the base member.
FIG. 7 is an enlarged detail view as indicated by arrow 7 in FIG. 4, with parts broken away showing the top end of the upper segment of the leg attached to the top rail member.
FIG. 8 is a top perspective view of the top and of the upper segment of the leg taken in direction of arrow 8 in FIG. 7.
FIG. 9 is a cross sectional view taken along line 9—9 in FIG. 4.
FIG. 10 is a cross sectional view taken along line 10—10 in FIG. 4, showing one of the casters in greater detail.

Turning now descriptively to the drawings, in which similar reference characters denote similar elements throughout the several views, the Figures illustrate an improved walker 20 for a handicapped and convalescent person 22. The improved walker 20 consists of a top rail member 24 having first and second sections 26 and 28, whereby the top rail member 24 surrounds an area to be occupied by the person 22. A base member 30 is provided having first and second sections 32 and 34, whereby the base member 30 surrounds the area to be occupied by the person 22. The base member 30 is larger in diameter than the top rail member 24. A plurality of legs 36 are attached at spaced locations between the top rail member 24 and the base member 30. A plurality of ground engaging casters 38 are attached at spaced locations to the underside of the base member 30.

A mechanism 40 is for pivotally connecting the first and second sections 26 and 28 of the top rail member 24 and the first and second sections 32 and 34 of the base member 30 together to allow the person 22 to enter the area to be occupied. Another mechanism 42 is for rigidly locking the free ends of the first and second sections 26 and 28 of the top rail member 24 and the first and second sections 32 and 34 of the base member 30 together after the person 22 has entered the area to be occupied, to securely enclose the person 22 in the occupied area. The person 22 can grip the top rail member 24 for support and move the improved walker 10 along the ground 44 with the hands free. A seat 46 made of a flexible piece of material, such as nylon or the like in an X-shaped configuration is attached between the first and second sections 26 and 28 of the top rail member 24 to drape and pass between the legs 48 of the person 22 using the improved walker 20. The seat 46 is removably attached on at least one side thereof. If the person 22 should loose balance and fall down, the seat 46 will support them while the larger base member 30 will help keep stability thereto and prevent the improved walker 10 from falling over.

Each pivotally connecting mechanism 40 is a hinge 50, while each locking mechanism 42 is a spring biased latch mechanism 52. Each caster 38 includes a ball shaped swivel wheel 54 and a spring shaft 55 to bias the ball shaped swivel wheel 54 to the underside of the base member 30 to serve as a shock absorber and a break mechanism when a weight is applied thereto.

Each leg 36 of the improved walker 20 includes two leg segments 56 and 58 which are telescopically adjustable to each other. A mechanism 60 is for retaining the two leg segments 56 and 58 in one of a variety of adjustable positions. A mechanism 62 is for releasably attaching the bottom end of the lower leg segment 56 to the base member 30. Mechanism 64 is for releasably attaching the top end of the upper leg segment 58 to the top rail member 24 so that the improved walker 10 can be disassembled for ease of storage when not being used.

The retaining mechanism 60 is a spring biased lock mechanism 66. The top end releasably attaching mechanism 64 includes the top rail member 24 having a bottom aperture 67. A rod 68 extends across the top rail member 24 above the bottom aperture 67. The top end of upper leg segment 58 has a pair of oppositely positioned L-shaped slots 70 which will engage with the rod 68 when the top end of the upper leg segment 58 is inserted within the bottom aperture 67 and is turned therein.

The bottom end releasably attaching mechanism 62 includes an annular rim 72 disposed about the bottom end of the lower leg segment 56. The base member 30 has a top aperture 74 with an annular groove 76 thereabout so that when the bottom end of the lower leg segment 56 is inserted within the top aperture 74, said annular rim 72 will be retained in the annular groove 76.

A stem 78 can extend upwardly on the top rail member 26 to connect an IV bag or the like thereto. A buzzer 80 can be on the top rail member 26 so that the person 22 can call for help. A remote tracing device 82 can be on the top rail member 26 to be used in hospitals and nursing homes. Hook 84 can extend downwardly on the top rail member 26 to engage a bag to carry things therein. Other accessories, such as a fold up mirror, compartments for beverages, snacks and cosmetics can be added to the top rail member 26.

The top rail member 26 can further include a padding 88 to fit thereon for comfort when gripped by the hands 90 of the person 22 and as a cushion under the arms 92 of the person 22 if needed for support so that the hands 90 of the person 22 can be free to do other things. The improved walker 10 can be fabricated out of stainless steel, aluminum or any other durable material while the seat 46 can be removed so that it can be washed or replaced if needed.

LIST OF REFERENCE NUMBERS

20 improved walker
22 handicapped and convalescent person
24 top rail member
26 first section of 24
28 second section of 24
30 base member
32 first section of 30
34 second section of 30
36 leg of 20
38 caster
40 pivotally connecting mechanism
42 rigidly locking mechanism
44 ground
46 seat
48 leg of 22
50 hinge
52 spring biased latch mechanism
54 ball shaped swivel wheel
55 spring shaft
56 lower leg segment of 36
58 upper leg segment of 36
60 retaining mechanism
62 bottom end releasably attaching mechanism
64 top end releasably attaching mechanism
66 spring biased lock mechanism of 60
67 bottom aperture in 24
68 rod
70 L-shaped slot in 58
72 annular rim on 56
74 top aperture in 30
76 annular groove in 74
78 stem on 26
80 buzzer on 26
82 remote tracking device on 26
84 hook on 26
88 padding
90 hands of 22
92 arms of 22

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved walker for a handicapped and convalescent person, said improved walker comprising:

a) a top rail member having first and second sections, whereby said top rail member surrounds an area to be coupled by the person;

b) a base member having first and second sections, whereby said base member surrounds the area to be occupied by the person, said base member being larger in diameter than said top rail member;

c) a plurality of legs attached at spaced locations between said top rail member and said base member, each said leg member including:

i) two leg segments which are telescopically adjustable to each other;

ii) means for retaining said two leg segments in one of a variety of adjustable positions;

iii) means for releasably attaching the bottom end of said lower leg segment to said base member; and iv) means at a top end of each upper leg segment for releasably attaching said upper leg segment to the top rail so that the improved walker may be height adjustable and/or disassembled for storage and transport;

d) a plurality of ground engaging casters attached at spaced locations to the underside of said base member;

e) means for pivotally connecting said first and second sections of said top rail and said first and second sections of said base member together to allow the person to enter the area to be occupied;

f) means for rigidly locking free ends of said first and second sections of said top rail member and said first and second sections of said base member together after the person has entered the area to be occupied, to securely enclosed the person in the occupied area, whereby the person can grip said top rail member for support and to move said improved walker along the ground with the hands free; and g) a seat, made of a flexible piece of material in an X-shaped configuration, attached between said first and second sections of said top rail member to drape and pass between the legs of the person using said improved walker, said seat being removably attached on at least one side thereof whereby if the person should loose balance and fall down said seat will support them while said larger base member will help keep stability thereto and prevent said improved walker from falling over.

2. An improved walker as recited in claim 1, wherein each said pivotally connecting means is a hinge.

3. An improved walker as recited in claim 2, wherein each said locking means is a spring biased latch mechanism.

4. An improved walker as recited in claim 3, wherein each said caster includes:

a) a ball shaped swivel wheel; and b) a spring shaft to bias said ball shaped swivel wheel to said underside of said base member to serve as a shock absorber and a break mechanism when a weight is applied thereto.

5. An improved walker as recited in claim 1, wherein said retaining means is a spring biased lock mechanism.

6. An improved walker as recited in claim 5, wherein said top end releasably attaching means includes:

a) said top rail member having a bottom aperture;

b) a rod extending across said top rail member above said bottom aperture; and c) said top end of said upper leg segment having a pair of oppositely positioned L-shaped slots which will engage with said rod when said top end of said upper leg segment is inserted within said bottom aperture and turned therein.

7. An improved walker as recited in claim 6, wherein said bottom end releasably attaching means includes:

a) an annular rim disposed about said bottom end of said lower leg segment; and b) said base member having a top aperture with an annular groove thereabout so that when said bottom end of said lower leg segment is inserted within said top aperture, said annular rim will be retained in said annular groove.

8. An improved walker as recited in claim 7, wherein said top rail member further includes:

a) a stem extending upwardly on said top rail member to connect an IV bag or the like thereto;

b) a buzzer on said top rail member so that the person can call for help;

c) a remote tracking device on said top rail member that can be used in hospitals and nursing homes; and d) a hook extending downwardly on said top rail member to engage a bag to carry things therein.

9. An improved walker as recited in claim 8, wherein said top rail member further includes a padding to fit thereon for comfort when gripped by the hands of the person and as a cushion under the arms of the person if needed for support so that the hands of the person can be free to do other things.

* * * * *